US011764481B2

(12) United States Patent
Liu et al.

(10) Patent No.: US 11,764,481 B2
(45) **Date of Patent: *Sep. 19, 2023**

(54) ANTENNA

(71) Applicant: HUAWEI TECHNOLOGIES CO., LTD., Guangdong (CN)

(72) Inventors: Wei Liu, Xi'an (CN); Weihong Xiao, Dongguan (CN); Dingjiu Daojian, Dongguan (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/577,703

(22) Filed: Jan. 18, 2022

(65) Prior Publication Data

US 2022/0328976 A1 Oct. 13, 2022

Related U.S. Application Data

(63) Continuation of application No. 16/684,054, filed on Nov. 14, 2019, now Pat. No. 11,245,199, which is a (Continued)

(51) Int. Cl.
*H01Q 19/17* (2006.01)
*H01Q 21/06* (2006.01)
(Continued)

(52) U.S. Cl.
CPC ..... *H01Q 19/17* (2013.01); *H01Q 5/392* (2015.01); *H01Q 5/48* (2015.01); *H01Q 19/005* (2013.01); *H01Q 21/062* (2013.01); *H01Q 21/24* (2013.01)

(58) Field of Classification Search
CPC .... H01Q 1/523; H01Q 21/062; H01Q 19/108; H01Q 5/48; H01Q 5/49; H01Q 19/17;
(Continued)

(56) References Cited

U.S. PATENT DOCUMENTS 3,541,559 A 11/1970 Evans
5,952,983 A 9/1999 Dearnley et al.
(Continued)

FOREIGN PATENT DOCUMENTS

CN 101662068 3/2010
CN 203521623 4/2014
(Continued)

OTHER PUBLICATIONS

Extended European Search Report issued in European Application No. 17910170.4 dated Mar. 16, 2020, 12 pages.
(Continued)

*Primary Examiner* — Vibol Tan
(74) *Attorney, Agent, or Firm* — Fish & Richardson P.C.

(57) ABSTRACT

The present disclosure relates to antennas. One example antenna includes a reflective device, at least two radiating arrays whose operating bands are in a first preset frequency band, and a plurality of parasitic radiators. Each radiating array of the at least two radiating arrays includes a plurality of radiating elements. Each radiating array of the at least two radiating arrays is electrically disposed on the reflective device along a length direction of the reflective device, and the plurality of parasitic radiators are disposed between two adjacent radiating arrays in the at least two radiating arrays.

20 Claims, 10 Drawing Sheets

Related U.S. Application Data continuation of application No. PCT/CN2017/084593, filed on May 16, 2017.

(51) Int. Cl.

| | |
|---|---|
| ***H01Q 21/24*** | (2006.01) |
| ***H01Q 5/392*** | (2015.01) |
| ***H01Q 19/00*** | (2006.01) |
| ***H01Q 5/48*** | (2015.01) |

(58) Field of Classification Search

CPC ..... H01Q 21/065; H01Q 15/14; H01Q 5/392; H01Q 9/0407; H01Q 9/065; H01Q 21/24; H01Q 5/385; H01Q 19/005

See application file for complete search history.

(56) References Cited

U.S. PATENT DOCUMENTS

| | | | | |
|---|---|---|---|---|
| 6,025,812 | A | 2/2000 | Gabriel et al. | |
| 6,734,829 | B1 | 5/2004 | Göttl | |
| 8,497,814 | B2 | 7/2013 | Puente et al. | |
| 10,290,930 | B2 | 5/2019 | Blackadder et al. | |
| 10,700,441 | B2 * | 6/2020 | Watson | H01Q 21/26 |
| 10,833,401 | B2 * | 11/2020 | Thotahewa | H01Q 1/246 |
| 10,931,035 | B2 | 2/2021 | Song et al. | |
| 11,108,137 | B2 * | 8/2021 | Liu | H01Q 1/246 |
| 2011/0063190 | A1 | 3/2011 | Ho et al. | |
| 2014/0368395 | A1 | 12/2014 | Dauguet et al. | |
| 2016/0254594 | A1 | 9/2016 | Jones et al. | |
| 2017/0062952 | A1 * | 3/2017 | Sundararajan | H01Q 1/246 |

FOREIGN PATENT DOCUMENTS

| | | |
|---|---|---|
| CN | 103943970 | 7/2014 |
| CN | 104979635 | 10/2015 |
| CN | 205646175 | 10/2016 |
| CN | 206259501 | 6/2017 |
| WO | 9959223 | 11/1999 |
| WO | 2015029946 | 3/2015 |
| WO | 2018209577 | 11/2018 |

OTHER PUBLICATIONS

Office Action issued in Chinese Application No. 201780090591.8 dated Feb. 20, 2021, 5 pages.

Office Action issued in Chinese Application No. 201780090591.8 dated May 7, 2020, 20 pages (with English translation).

PCT International Search Report and Written Opinion issued in International Application No. PCT/CN2017/084593 dated Feb. 13, 2018, 17 pages (with English translation).

Zheng Ru-ping et al., "A Pattern Reconfigurable Antenna Array with Five Printed Monopoles," Journal of Microwaves, vol. 29, No. 3, Jun. 2013, 5 pages (English abstract).

* cited by examiner

ANTENNA

CROSS-REFERENCE TO RELATED APPLICATIONS

This application is a continuation of U.S. patent application Ser. No. 16/684,054, filed on Nov. 14, 2019, which is a continuation of International Application No. PCT/CN2017/084593, filed on May 16, 2017. All of the afore-mentioned patent applications are hereby incorporated by reference in their entireties.

TECHNICAL FIELD

The present invention relates to the field of wireless communications technologies, and in particular, to an antenna.

BACKGROUND

With popularization of wireless communications systems, multi-array antennas have been widely applied. At present, a multi-array antenna mainly includes a reflective device and a plurality of radiating arrays whose operating bands are in a preset frequency band. The plurality of radiating arrays are disposed on the reflective device.

There is coupling influence between two adjacent radiating arrays whose operating bands are in a same preset frequency band. Therefore, when one radiating array operates, a generated radiated electromagnetic wave (which may be referred to as a primary radiated electromagnetic wave) excites an adjacent radiating array to generate a parasitic radiated electromagnetic wave. Superposition of the parasitic radiated electromagnetic wave and the primary radiated electromagnetic wave broadens a horizontal beamwidth of the multi-array antenna. Consequently, a directivity pattern index of the multi-array antenna does not meet a requirement of the wireless communications system.

SUMMARY

To reduce a horizontal beamwidth of a multi-array antenna, an embodiment of the present invention provides an antenna. The antenna includes a reflective device, at least two radiating arrays whose operating bands are in a first preset frequency band, and a plurality of parasitic radiators. Each of the at least two radiating arrays includes a plurality of radiating elements.

Each of the at least two radiating arrays is electrically disposed on the reflective device along a length direction of the reflective device, and the plurality of parasitic radiators are disposed between two adjacent radiating arrays in the at least two radiating arrays.

In a possible implementation, the plurality of parasitic radiators include a plurality of transversal parasitic radiators; and each of the plurality of transversal parasitic radiators is disposed along a width direction of the reflective device; the plurality of transversal parasitic radiators are separately disposed on two sides of each radiating element pair included in the two adjacent radiating arrays; and each of the two adjacent radiating arrays includes one radiating element in each radiating element pair.

In this way, the transversal parasitic radiators are disposed on the two sides of each radiating element pair included in the two adjacent radiating arrays. When a radiating array operates, the transversal parasitic radiators can generate a parasitic radiated electromagnetic wave whose direction is opposite to a direction of a parasitic radiated electromagnetic wave generated by an adjacent radiating array. In other words, the parasitic radiated electromagnetic wave generated by the transversal parasitic radiators can cancel out the parasitic radiated electromagnetic wave generated by the adjacent radiating array. This reduces a horizontal beamwidth of a multi-array antenna, and further allows a directivity pattern index of the multi-array antenna to meet a requirement of a wireless communications system.

In a possible implementation, a distance between a midpoint of a vertical projection of each transversal parasitic radiator on a bottom surface of the reflective device and a line connecting a radiating element pair corresponding to the transversal parasitic radiator is a preset distance value; and the vertical projection of each transversal parasitic radiator on the bottom surface of the reflective device is parallel to the line connecting the radiating element pair corresponding to the transversal parasitic radiator.

In a possible implementation, the midpoint of the vertical projection of each transversal parasitic radiator on the bottom surface of the reflective device is on a line connecting midpoints of radiating element pairs corresponding to the transversal parasitic radiator.

In a possible implementation, a height from a vertex of each transversal parasitic radiator to the bottom surface of the reflective device is a value in a preset range including 0.25 times a wavelength, and the wavelength is an average value of wavelengths of two adjacent radiating arrays corresponding to each transversal parasitic radiator.

In a possible implementation, an effective length of each transversal parasitic radiator is a value in a range of 0.8 times the wavelength to 2.5 times the wavelength, and the wavelength is the average value of the wavelengths of the two adjacent radiating arrays corresponding to each transversal parasitic radiator.

In a possible implementation, the plurality of parasitic radiators include a plurality of longitudinal parasitic radiators; and each of the plurality of longitudinal parasitic radiators is disposed along the length direction of the reflective device, and the plurality of longitudinal parasitic radiators are separately disposed between two radiating elements included in each radiating element pair.

In a possible implementation, a midpoint of a vertical projection of each longitudinal parasitic radiator on the bottom surface of the reflective device coincides with a midpoint of a line connecting a radiating element pair corresponding to the longitudinal parasitic radiator, and the vertical projection of each longitudinal parasitic radiator on the bottom surface of the reflective device is perpendicular to the line connecting the radiating element pair corresponding to the longitudinal parasitic radiator.

In a possible implementation, a height from a vertex of each longitudinal parasitic radiator to the bottom surface of the reflective device is a value in a preset range including 0.25 times a wavelength, and the wavelength is an average value of wavelengths of two adjacent radiating arrays corresponding to each longitudinal parasitic radiator.

In a possible implementation, an effective length of each longitudinal parasitic radiator is a value in a range of 0.8 times the wavelength to 2.5 times the wavelength, and the wavelength is the average value of the wavelengths of the two adjacent radiating arrays corresponding to each longitudinal parasitic radiator.

In a possible implementation, each radiating element included in each of the at least two radiating arrays is a dual-polarized dipole radiating element; or each radiating element included in each of the at least two radiating arrays is a single-polarized dipole radiating element.

In a possible implementation, the first preset frequency band is a preset low-frequency band, or the first preset frequency band is a preset high-frequency band.

The technical solution provided in this embodiment of the present invention brings about the following beneficial effects:

In this embodiment of the present invention, the parasitic radiators are disposed between the two adjacent radiating arrays. When a radiating array operates, the parasitic radiators can generate the parasitic radiated electromagnetic wave whose direction is opposite to the direction of the parasitic radiated electromagnetic wave generated by the adjacent radiating array. In other words, the parasitic radiated electromagnetic wave generated by the parasitic radiators can cancel out the parasitic radiated electromagnetic wave generated by the adjacent radiating array. This reduces the horizontal beamwidth of the multi-array antenna, and further allows the directivity pattern index of the multi-array antenna to meet the requirement of the wireless communications system.

BRIEF DESCRIPTION OF DRAWINGS

FIG. 1(*b*) is a schematic diagram of an antenna according to an embodiment of the present invention;

FIG. 2(*b*) is a schematic diagram of an antenna according to an embodiment of the present invention;

FIG. 3(*b*) is a schematic diagram of an antenna according to an embodiment of the present invention;

FIG. 5(*b*) is a schematic diagram of an antenna according to an embodiment of the present invention;

FIG. 5(*c*) is a schematic diagram of an antenna according to an embodiment of the present invention;

FIG. 6(*b*) is a schematic diagram of an antenna according to an embodiment of the present invention;

FIG. 6(*c*) is a schematic diagram of an antenna according to an embodiment of the present invention;

FIG. 6(*d*) is a schematic diagram of an antenna according to an embodiment of the present invention;

FIG. 7(*b*) is a schematic diagram of an antenna according to an embodiment of the present invention;

FIG. 8(*b*) is a schematic diagram of an antenna according to an embodiment of the present invention;

FIG. 9(*b*) is a schematic diagram of an antenna according to an embodiment of the present invention.

REFERENCE NUMERALS

1. Reflective device; 2. First-type radiating array;
3. Parasitic radiator; 31. Transversal parasitic radiator;
32. Longitudinal parasitic radiator; 21. Radiating element in the first-type radiating array;
4. Second-type radiating array; 41. Radiating element in the second-type radiating array

DESCRIPTION OF EMBODIMENTS

Figure 1A:
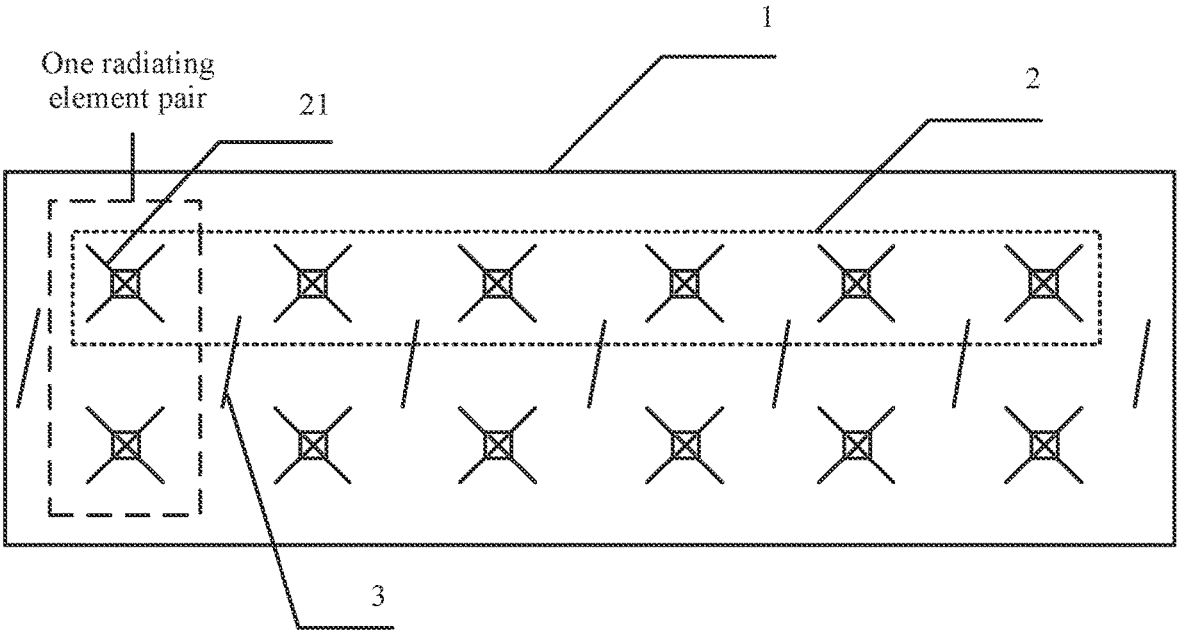
FIG. 1(*a*) is a schematic diagram of an antenna according to an embodiment of the present invention.
Figure 1B:
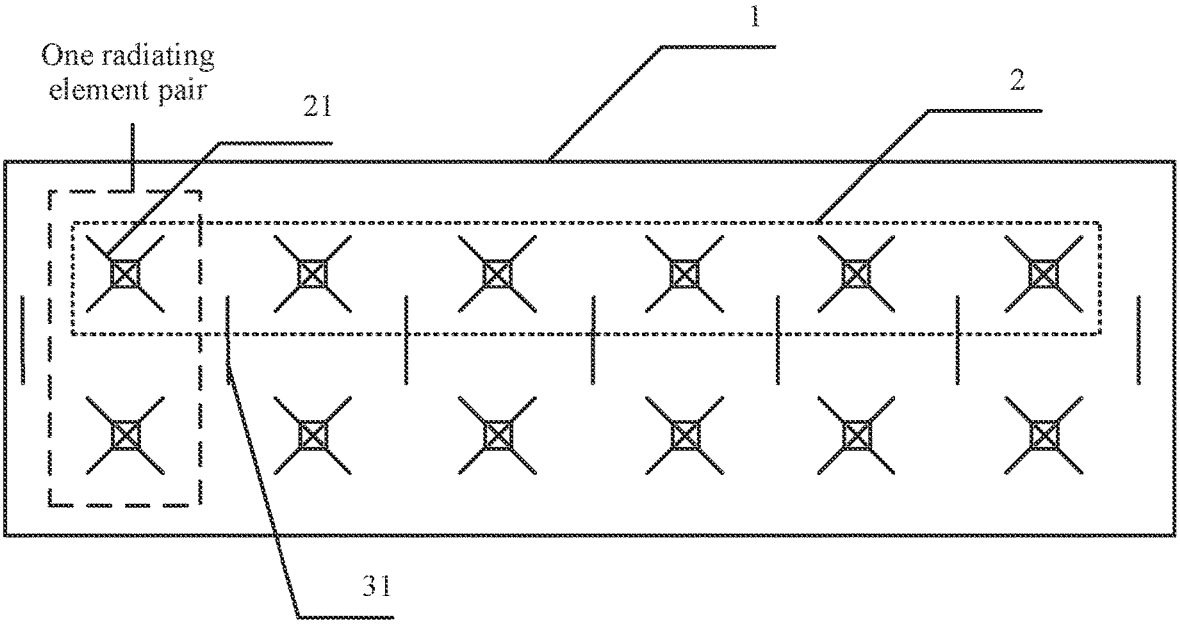

An embodiment of the present invention provides an antenna. As shown in FIG. 1(*a*), the antenna includes a reflective device 1, at least two radiating arrays 2 whose operating bands are in a first preset frequency band, and a plurality of parasitic radiators 3. The first preset frequency band may be a preset low-frequency band, for example, the first preset frequency band is 690 MHz (megahertz) to 960 MHz. Alternatively, the first preset frequency band may be a preset high-frequency band, for example, the first preset frequency band is 1710 MHz to 2690 MHz. In addition, the at least two radiating arrays may correspond to different operating bands or a same operating band (in other words, the operating band corresponding to each radiating array may be a subband in the first preset frequency band), and may correspond to a same operating bandwidth or different operating bandwidths. For example, the antenna includes a radiating array a and a radiating array b. An operating frequency of the radiating array a may be 850 MHz to 890 MHz (a corresponding operating bandwidth is 40 MHz), and an operating frequency of the radiating array b may be 900 MHz to 940 MHz (a corresponding operating bandwidth is 40 MHz).

Each of the at least two radiating arrays 2 included in the antenna may include a plurality of radiating elements 21. Each radiating array 2 includes a same quantity of radiating elements. For every two adjacent radiating arrays (operating bands of the two adjacent radiating arrays are both in the first preset frequency band), along a width direction of the reflective device 1, radiating elements corresponding to the two radiating arrays may be referred to as a radiating element pair, and a quantity of radiating element pairs included in every two adjacent radiating arrays is the same as a quantity of radiating elements included in each radiating array. For example, the radiating array a and the radiating array b are adjacent radiating arrays whose operating bands are both in the first preset frequency band. In this case, the first radiating element of the radiating array a and the first radiating element of the radiating array b may be referred to as a radiating element pair, the second radiating element of the radiating array a and the second radiating element of the radiating array b may be referred to as a radiating element pair, and so on. Each radiating array may be electrically disposed on the reflective device 1 along a length direction (namely, a longitudinal direction or a column direction) of the reflective device 1. The reflective device 1 is a metal reflection panel. The at least two radiating arrays 2 may be directly electrically connected to the reflective device 1 (for example, may be directly connected to the reflective device 1 through a rivet or a screw), or electrically coupled to the reflective device 1 (for example, may be electrically connected to the reflective device 1 through a printed circuit board (PCB)).

In addition, each radiating element 21 may include at least one grounding device, at least one group of antenna baluns, a radiation arm (when the radiating element is a single-polarized dipole radiating element, each radiating element includes at least two radiation arms, or when the radiating element is a dual-polarized dipole radiating element, each radiating element includes at least four radiation arms). The at least one grounding device is directly electrically disposed on or is electrically coupled to the reflective device 1. A height of the at least one group of antenna baluns may be a value in a preset range including 0.25 times a wavelength. The wavelength is a wavelength (which may be referred to as a central wavelength) corresponding to a center frequency of an operating band of the radiating element. For example, if the operating band of the radiating element is 850 MHz to 890 MHz, the center frequency is (850+890)/2, and the wavelength is a wavelength corresponding to the center frequency. One end of each group of antenna baluns may be connected to the grounding device, and the other end of the antenna baluns is connected to the radiation arm. A length of each radiation arm may also be a value in the preset range including 0.25 times the wavelength. In addition, a distance between adjacent radiating elements included in each radiating array 2 is approximately a value in a range of 0.5 times the wavelength to 1.2 times the wavelength. Distances between adjacent radiating elements included in each radiating array 2 are approximately equal. A distance between two radiating elements in a radiating element pair included in two adjacent radiating arrays is approximately a value in a range of 0.4 times the wavelength to 0.8 times the wavelength.

The plurality of parasitic radiators 3 included in the antenna may be metal strips. The parasitic radiator 3 may also be referred to as a metal strip, a parasitic strip, or an isolating bar. The plurality of parasitic radiators may be disposed between two adjacent radiating arrays.

Optionally, the length direction of the reflective device 1 may be defined as the longitudinal direction or the column direction, and the width direction of the reflective device 1 may be defined as a horizontal direction. In this case, the plurality of parasitic radiators 3 may include a plurality of transversal parasitic radiators 31 disposed along the width direction of the reflective device 1. To be specific, each of the plurality of transversal parasitic radiators 31 may be disposed along the width direction of the reflective device 1. The plurality of transversal parasitic radiators 31 may be separately disposed on two sides of each radiating element pair included in the two adjacent radiating arrays, as shown in FIG. 1(*b*). Specifically, transversal parasitic radiators 31 may be disposed on two sides of each radiating element pair included in the two adjacent radiating arrays, or transversal parasitic radiators 31 may be disposed on two sides of a radiating element pair other than a radiating element pair located at an edge in the two adjacent radiating arrays, or transversal parasitic radiators 31 may be disposed on two sides of each radiating element pair that corresponds to an input power greater than a preset power threshold and that is included in the two adjacent radiating arrays, or transversal parasitic radiators 31 may be disposed on two sides of a preset quantity of radiating element pairs that correspond to a maximum input power and that are included in the two adjacent radiating arrays, where a radiating element in the middle corresponds to the maximum input power, and input powers of radiating elements located on two sides of the radiating element in the middle successively decrease. In this way, the transversal parasitic radiators 31 are disposed on the two sides of each radiating element pair included in the two adjacent radiating arrays. When a radiating array operates, the transversal parasitic radiators 31 can generate a parasitic radiated electromagnetic wave whose direction is opposite to a direction of a parasitic radiated electromagnetic wave generated by an adjacent radiating array. In other words, the parasitic radiated electromagnetic wave generated by the transversal parasitic radiators 31 can cancel out the parasitic radiated electromagnetic wave generated by the adjacent radiating array. This reduces a horizontal beamwidth of a multi-array antenna, and further allows a directivity pattern index of the multi-array antenna to meet a requirement of a wireless communications system.

Optionally, to better reduce the horizontal beamwidth of the multi-array antenna, when the plurality of transversal parasitic radiators 31 are being disposed, a distance between a midpoint of a vertical projection of each of the plurality of transversal parasitic radiators 31 on a bottom surface of the reflective device 1 and a line connecting a radiating element pair corresponding to each transversal parasitic radiator 31 may be allowed to be a preset distance value; and the vertical projection of each transversal parasitic radiator 31 on the bottom surface of the reflective device 1 or an axis of the vertical projection is parallel to the line connecting the radiating element pair corresponding to the transversal parasitic radiator 31. The radiating element pair corresponding to each transversal parasitic radiator 31 may be a radiating element pair on two sides of the transversal parasitic radiator 31. In other words, each transversal parasitic radiator 31 may be disposed between two corresponding radiating element pairs, and a plane on which the transversal parasitic radiator 31 is located is parallel to a plane on which each corresponding radiating element pair is located. The line connecting the radiating element pair in this embodiment of the present invention is a line connecting two radiating elements included in the radiating element pair on the bottom surface of the reflective device.

Figure 2A:
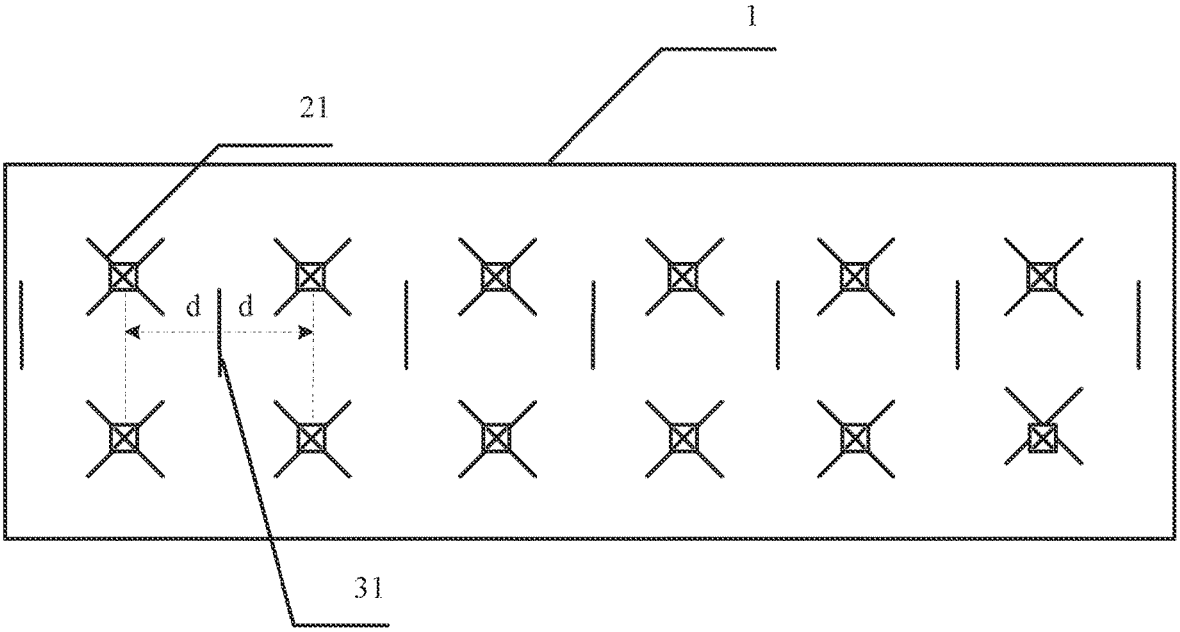
FIG. 2(*a*) is a schematic diagram of an antenna according to an embodiment of the present invention.
Figure 2B:
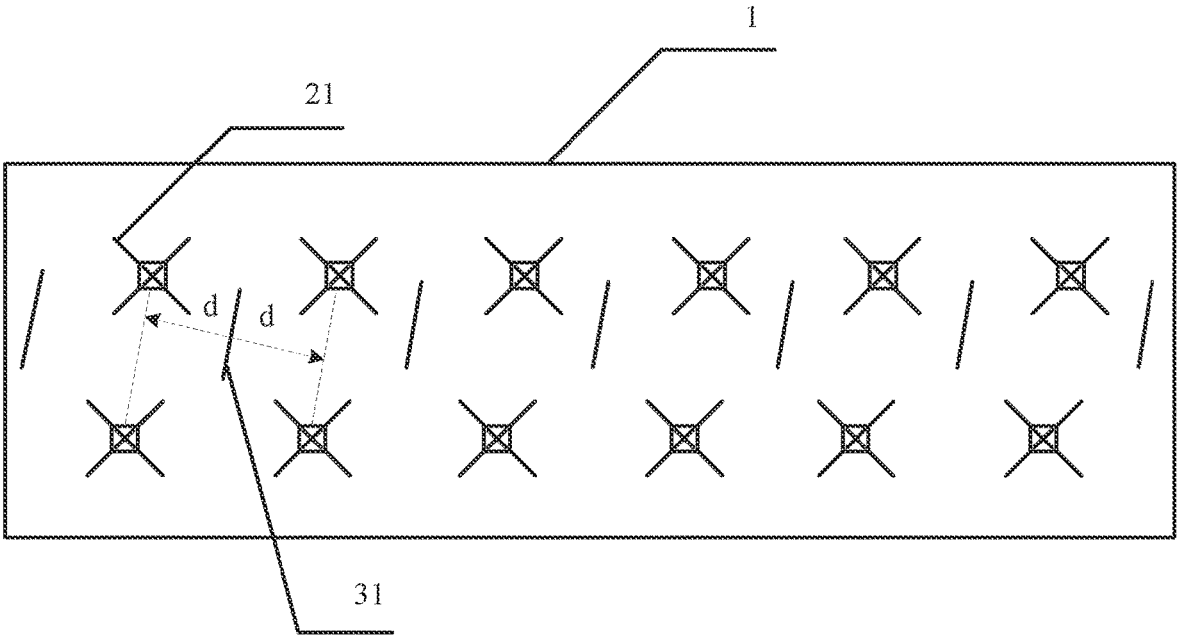

For example, if the line connecting the radiating element pair included in the two adjacent radiating arrays is parallel to a width side of the reflective device 1, the transversal parasitic radiator 31 may be disposed as shown in FIG. 2(*a*). If there is a particular angle between the line connecting the radiating element pair included in the two adjacent radiating arrays and the width side of the reflective device 1, the transversal parasitic radiator 31 may be disposed as shown in FIG. 2(*b*). FIG. 2(*a*) and FIG. 2(*b*) are top views of the antenna, that is, diagrams of a vertical projection of the antenna on the bottom surface of the reflective device.

Figure 3A:
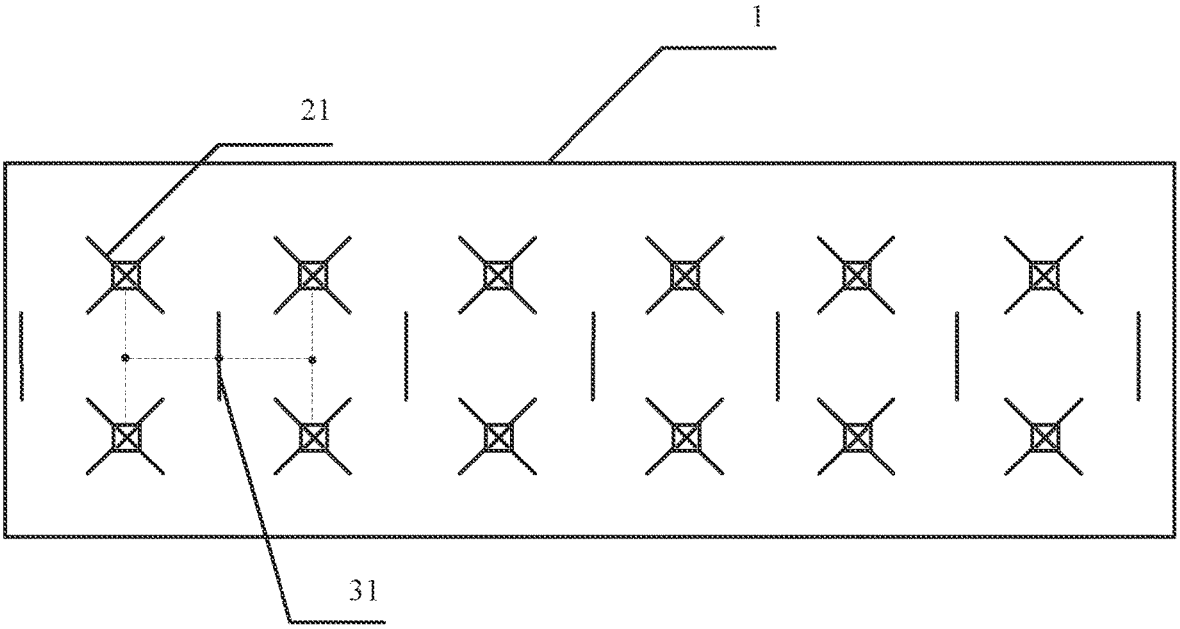
FIG. 3(*a*) is a schematic diagram of an antenna according to an embodiment of the present invention.
Figure 3B:
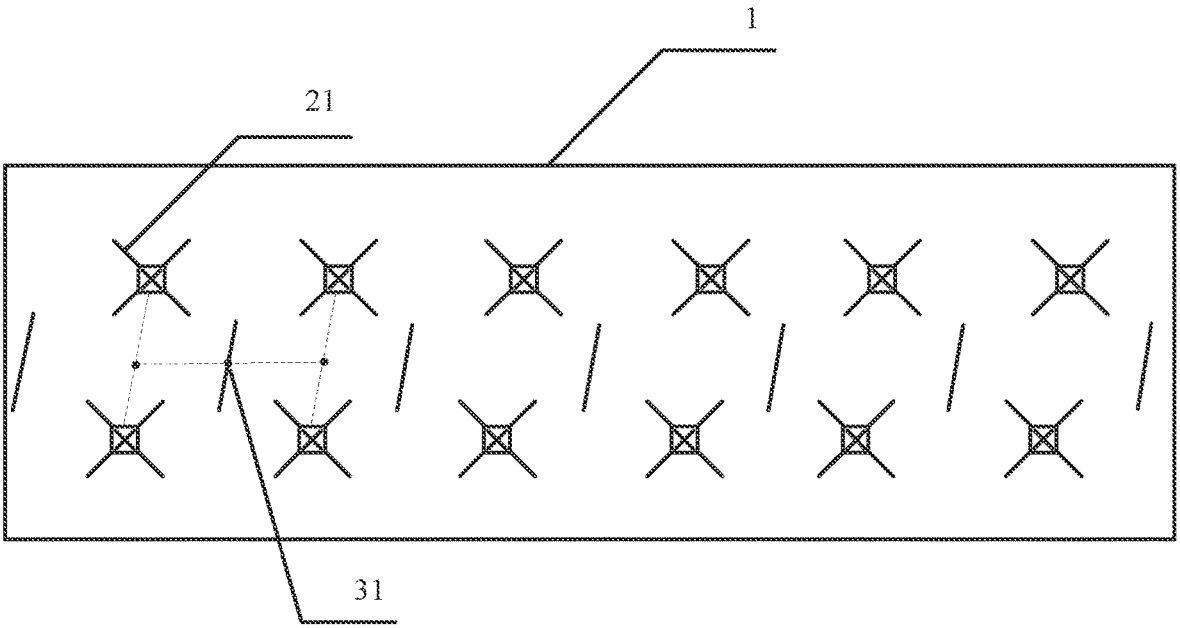

Optionally, the midpoint of the vertical projection of each of the plurality of transversal parasitic radiators 31 on the bottom surface of the reflective device 1 may be on a line connecting midpoints (the midpoint may be a midpoint of a line connecting radiating elements included in a radiating element pair) of radiating element pairs corresponding to each transversal parasitic radiator 31. In other words, for each transversal parasitic radiator 31, when the transversal parasitic radiator 31 is being disposed, in some cases, the transversal parasitic radiator 31 may be allowed to coincide with a geometric center of two radiating element pairs corresponding to the transversal parasitic radiator 31. To be specific, distances between the midpoint of the vertical projection of the transversal parasitic radiator 31 on the bottom surface of the reflective device 1 and axes of the two adjacent radiating arrays may be allowed to be the same as much as possible. For example, if the line connecting the radiating element pair included in the two adjacent radiating arrays is parallel to the width side of the reflective device, the transversal parasitic radiator may be disposed as shown in FIG. 3(*a*). If an included angle is formed between the line connecting the radiating element pair included in the two adjacent radiating arrays and the width side of the reflective device, the transversal parasitic radiator may be disposed as shown in FIG. 3(*b*). FIG. 3(*a*) and FIG. 3(*b*) are top views of the antenna, that is, diagrams of a vertical projection of the antenna on the bottom surface of the reflective device. In addition, when the plurality of transversal parasitic radiators 31 are being disposed, the distance between the midpoint of the vertical projection of each of the plurality of transversal parasitic radiators 31 on the bottom surface of the reflective device 1 and the line connecting the radiating element pair corresponding to each transversal parasitic radiator 31 may be allowed to be the preset distance value; the midpoint of the vertical projection of each of the plurality of transversal parasitic radiators 31 on the bottom surface of the reflective device 1 is on the line connecting the midpoints of the radiating element pairs corresponding to the transversal parasitic radiator 31; and the vertical projection of each transversal parasitic radiator 31 on the bottom surface of the reflective device 1 or the axis of the vertical projection is parallel to the line connecting the radiating element pair corresponding to the transversal parasitic radiator 31.

Optionally, when the radiating arrays 2 are being disposed, geometric centers of radiating elements in each radiating element pair included in the two adjacent radiating arrays may be allowed to be in a same straight line parallel to the width side of the reflective device 1, for example, in a manner of disposing the radiating element pairs shown in FIG. 1(*a*).

Optionally, when the radiating arrays 2 are being disposed, geometric centers of a plurality of radiating elements included in each of the at least two radiating arrays may be allowed to be in a same straight line parallel to a length side of the reflective device 1. To be specific, a longitudinal axis of each radiating array may be allowed to be parallel to the length side of the reflective device 1, for example, the manner of disposing the radiating arrays shown in FIG. 1(*a*).

Optionally, when the plurality of transversal parasitic radiators 31 are being disposed, heights and effective lengths of the plurality of transversal parasitic radiators 31 may be further allowed to meet a particular requirement. Specifically, when each transversal parasitic radiator 31 is being disposed, a height from a vertex of each transversal parasitic radiator 31 to the bottom surface of the reflective device 1 may be set to a value in a preset range including 0.25 times a wavelength. The wavelength is an average value (the wavelength may be referred to as an average wavelength) of wavelengths of the two adjacent radiating arrays corresponding to each transversal parasitic radiator 31. A wavelength of a radiating array is a wavelength corresponding to a center frequency of an operating band of the radiating array. For example, the antenna includes the radiating array a and the radiating array b, a center frequency of the radiating array a is A, and a center frequency of the radiating array b is B. In this case, the wavelength is an average value of a wavelength corresponding to A and a wavelength corresponding to B. In addition, a difference between an endpoint value of the preset range and the 0.25 times the wavelength is less than a preset threshold. For example, if the 0.25 times the wavelength is p, the preset range may be p−q to p+q, where q is a smaller value, and may be the preset threshold.

When each transversal parasitic radiator 31 is being disposed, the effective length of each transversal parasitic radiator 31 may be set to a value in a range of 0.8 times the wavelength to 2.5 times the wavelength. The effective length of each transversal parasitic radiator 31 may be approximately the value in the range of the 0.8 times the wavelength to the 2.5 times the wavelength, and a specific deviation may be allowed. A definition of the effective length may be the same as a definition of an effective length of a radiating element, and may be as follows: The antenna is placed in a Cartesian coordinate system; a physical geometric center of the antenna is set at an origin of coordinates; the length direction of the reflective device is set along a Z axis, and the width direction is set along an X axis; the transversal parasitic radiators 31 parallel to the width side of the reflective device are separately projected to an XY plane, an XZ plane, and a YZ plane; and a maximum length of projections that are straight lines on the planes is selected as the effective length of the transversal parasitic radiator 31. To be specific, in the top view of the antenna, or a side view along the length direction of the reflective device, or a side view along the width direction of the reflective device, a view in which a projection of the transversal parasitic radiator 31 is a straight line may be determined, and further, a length corresponding to a straight line with a maximum length may be used as the effective length of the transversal parasitic radiator 31.

Figure 4:
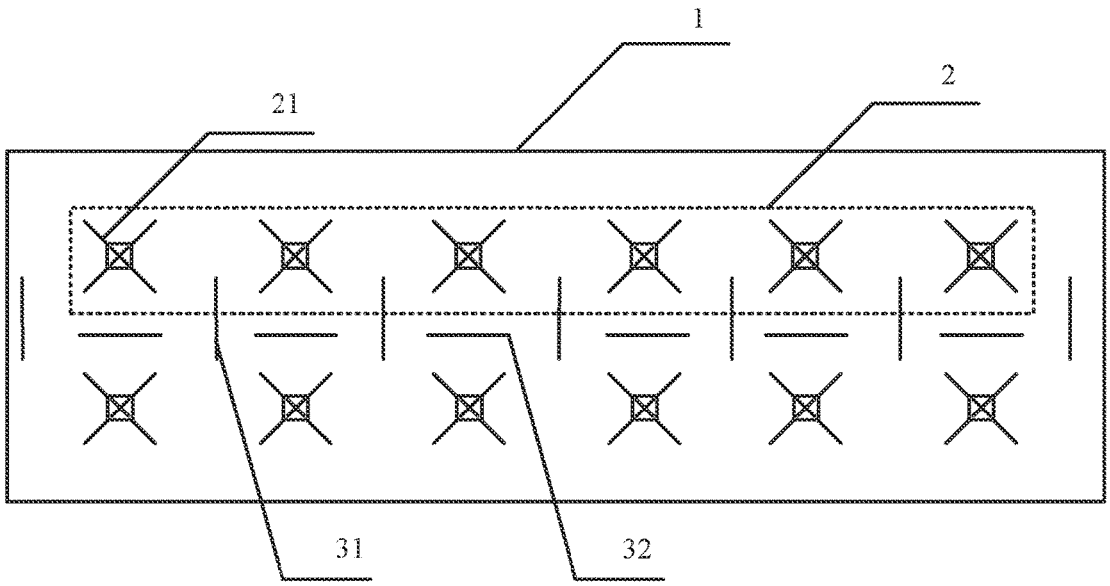
FIG. 4 is a schematic diagram of an antenna according to an embodiment of the present invention.

Optionally, as shown in FIG. 4, the plurality of parasitic radiators may further include a plurality of longitudinal parasitic radiators 32. When the longitudinal parasitic radiators 32 are being disposed, each longitudinal parasitic radiator 32 may be disposed, along the length direction of the reflective device 1, between two radiating elements included in a radiating element pair corresponding to the longitudinal parasitic radiator 32.

Figure 5A:
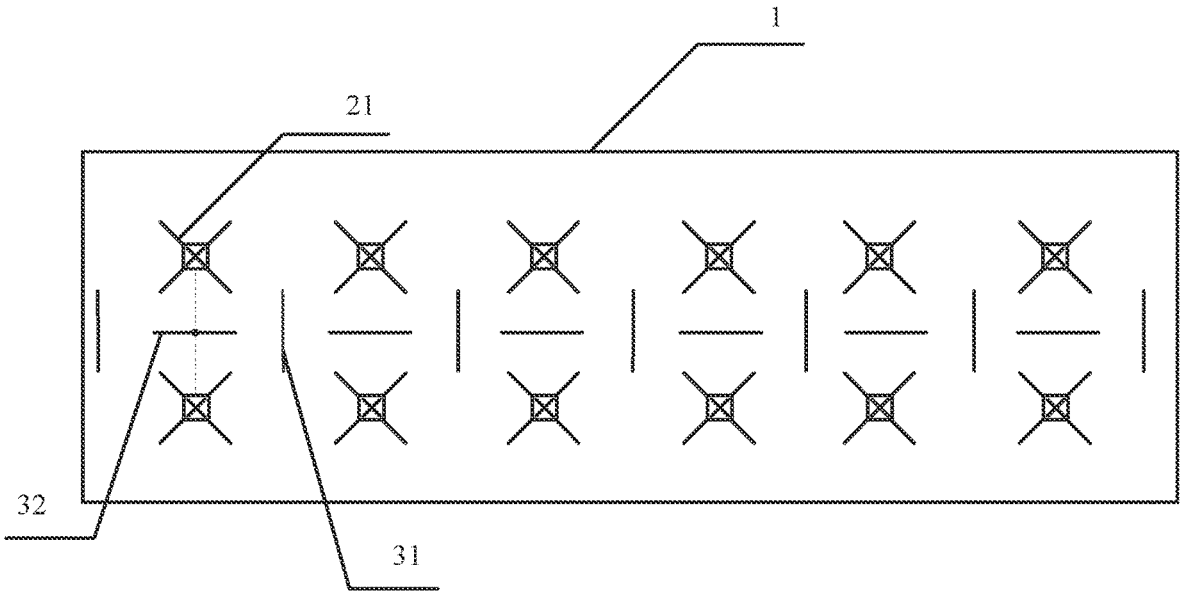
FIG. 5(*a*) is a schematic diagram of an antenna according to an embodiment of the present invention.
Figure 5B:
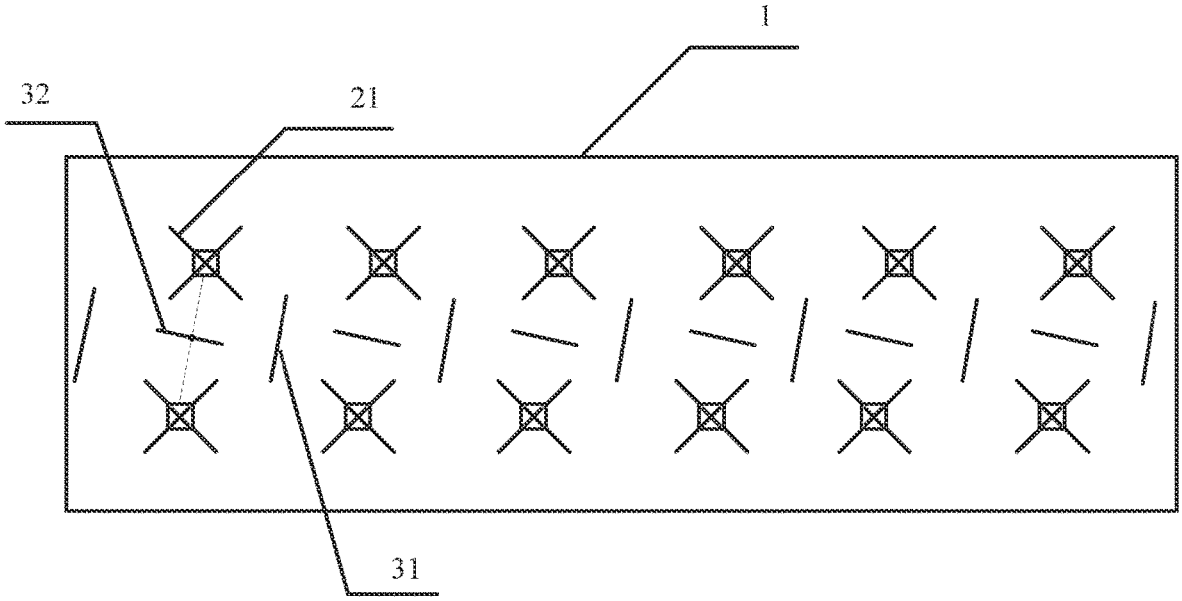
Figure 5C:
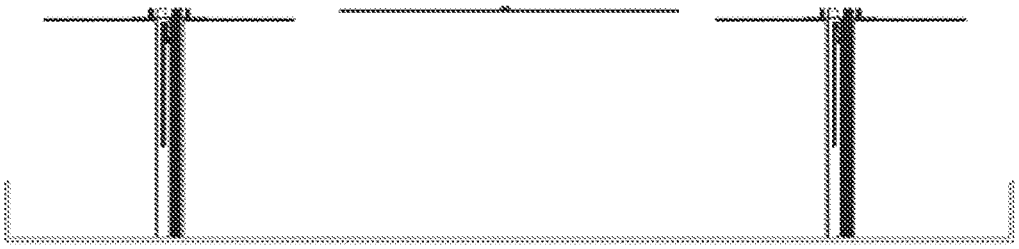
Figure 6A:
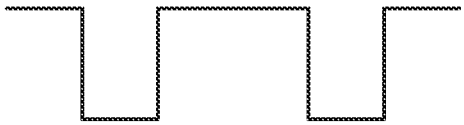
FIG. 6(*a*) is a schematic diagram of an antenna according to an embodiment of the present invention.
Figure 6B:
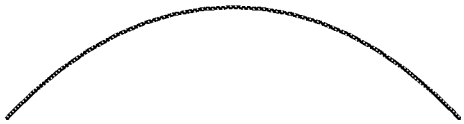
Figure 6C:
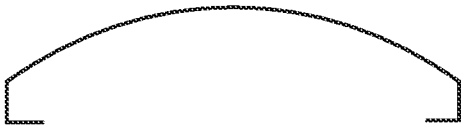
Figure 6D:
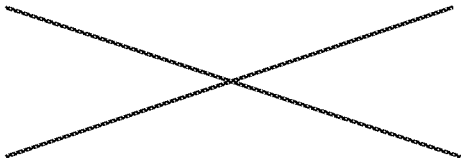

Optionally, to better reduce the horizontal beamwidth of the multi-array antenna, when the plurality of longitudinal parasitic radiators 32 are being disposed, a midpoint of a vertical projection of each longitudinal parasitic radiator 32 on the bottom surface of the reflective device 1 may be allowed to coincide with a midpoint of a line connecting the two radiating elements included in the radiating element pair corresponding to the longitudinal parasitic radiator 32, and the vertical projection of each longitudinal parasitic radiator 32 on the bottom surface of the reflective device 1 or an axis of the vertical projection is perpendicular to the line connecting the radiating element pair corresponding to the longitudinal parasitic radiator 32. The radiating element pair corresponding to each longitudinal parasitic radiator 32 may be a radiating element pair including radiating elements on two sides of the longitudinal parasitic radiator 32. In other words, each longitudinal parasitic radiator 32 may be disposed between the two radiating elements included in the corresponding radiating element pair, and is perpendicular to the line connecting the corresponding radiating element pair. For example, if the line connecting the radiating element pair included in the two adjacent radiating arrays is parallel to the width side of the reflective device, the longitudinal parasitic radiator 32 may be disposed as shown in FIG. 5(*a*). If there is a particular angle between the line connecting the radiating element pair included in the two adjacent radiating arrays and the width side of the reflective device, the longitudinal parasitic radiator 32 may be disposed as shown in FIG. 5(*b*). FIG. 5(*a*) and FIG. 5(*b*) are top views of the antenna, that is, diagrams of a vertical projection of the antenna on the bottom surface of the reflective device. A side view corresponding to FIG. 5(*a*) is shown in FIG. 5(*c*).

Optionally, when the plurality of longitudinal parasitic radiators 32 are being disposed, heights and effective lengths of the plurality of longitudinal parasitic radiators 32 may be further allowed to meet a particular requirement. Specifically, when each longitudinal parasitic radiator 32 is being disposed, a height from a vertex of the longitudinal parasitic radiator 32 to the bottom surface of the reflective device 1 may be set to a value in a preset range including 0.25 times a wavelength. The wavelength is an average value (the wavelength may be referred to as an average wavelength) of wavelengths of the two adjacent radiating arrays corresponding to each longitudinal parasitic radiator 32. In addition, a difference between an endpoint value of the preset range and the 0.25 times the wavelength is less than a preset threshold. For example, if the 0.25 times the wavelength is p, the preset range may be p−q to p+q, where q is a smaller value, and may be the preset threshold.

When each longitudinal parasitic radiator 32 is being disposed, the effective length of the longitudinal parasitic radiator 32 may be set to a value in a range of 0.8 times the wavelength to 2.5 times the wavelength. The effective length of each longitudinal parasitic radiator 32 may be approximately the value in the range of the 0.8 times the wavelength to the 2.5 times the wavelength, and a specific deviation may be allowed. A definition of the effective length of the longitudinal parasitic radiator 32 may be the same as the definition of the effective length of the transversal parasitic radiator.

In addition, the transversal parasitic radiator 31 and the longitudinal parasitic radiator 32 may be secured on the bottom surface of the reflective device 1 by using supports. The supports may be plastic supports. The transversal parasitic radiator 31 and the longitudinal parasitic radiator 32 may be in diversified shapes. This embodiment of the present invention provides several feasible shapes of the transversal parasitic radiator 31 or the longitudinal parasitic radiator 32, which are separately shown in FIG. 6(*a*), FIG. 6(*b*), FIG. 6(*c*), and FIG. 6(*d*). The transversal parasitic radiator 31 and the longitudinal parasitic radiator 32 may be axisymmetrical parasitic radiators.

Optionally, each radiating element included in each of the at least two radiating arrays included in the antenna may be a dual-polarized dipole radiating element. A dual-polarized dipole of each radiating element may be disposed at an angle of positive/negative 45 degrees. Each dual-polarized dipole radiating element may be a dipole interconnection unit, a dipole bowl-shaped unit, a dipole patch unit, or the like. Each radiating element may alternatively be a single-polarized dipole radiating element.

Figure 7A:
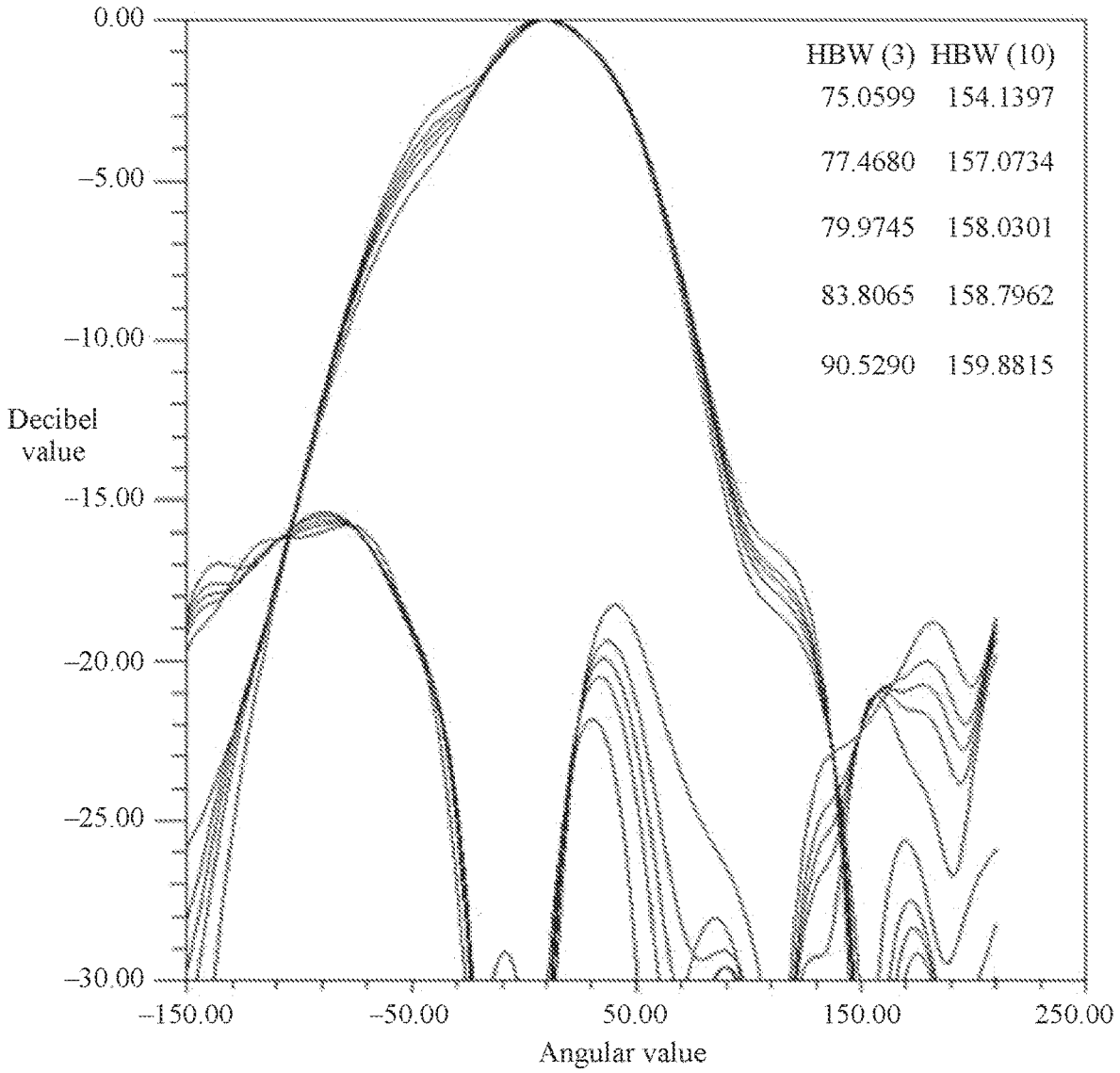
FIG. 7(*a*) is a schematic diagram of an antenna according to an embodiment of the present invention.
Figure 7B:
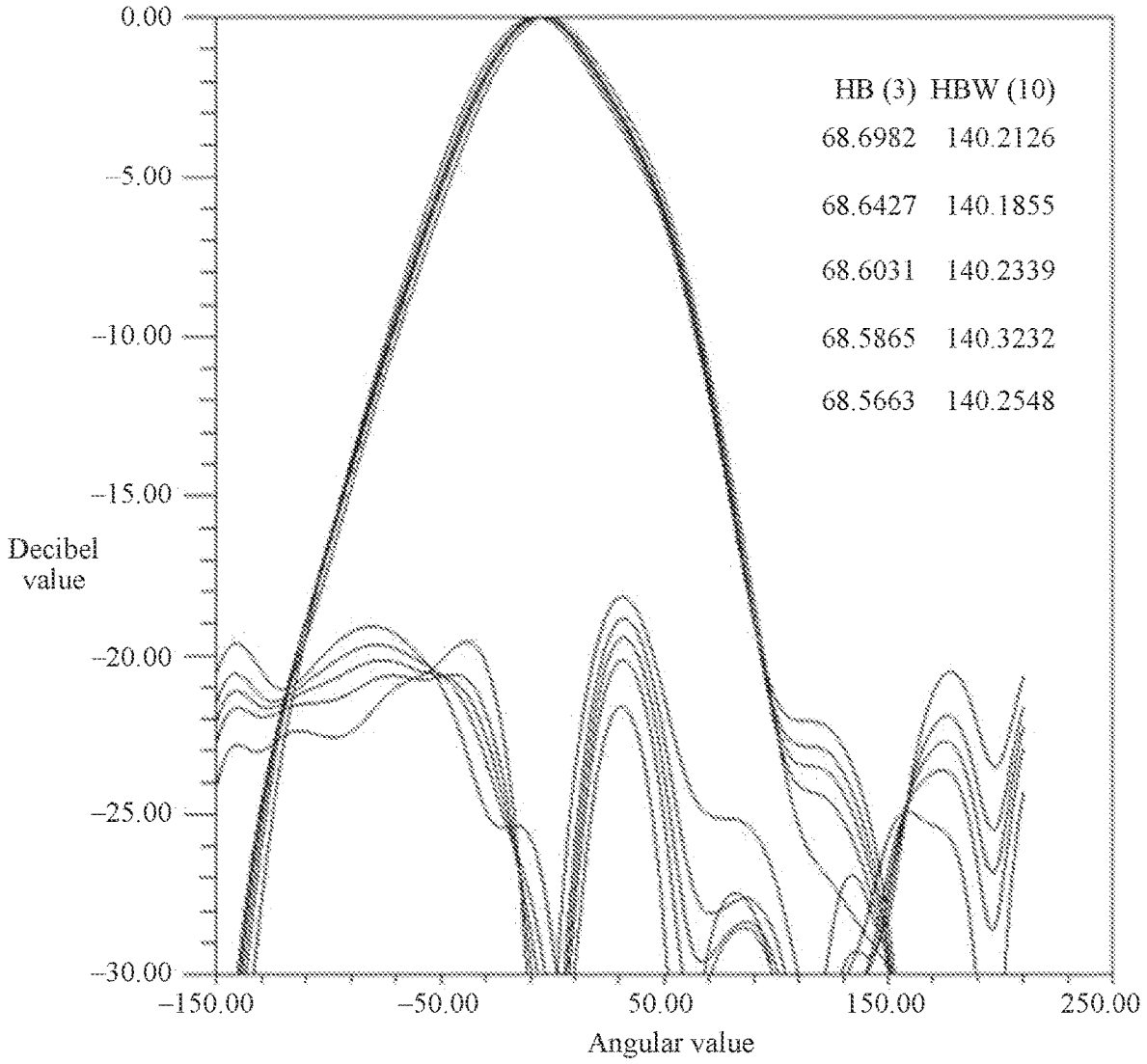

In this solution, the transversal parasitic radiators and the longitudinal parasitic radiators are disposed to reduce the horizontal beamwidth of the multi-array antenna. A horizontal plane directivity pattern of an antenna on which no transversal parasitic radiator and no longitudinal parasitic radiator are disposed is shown in FIG. 7(*a*). A horizontal plane directivity pattern of an antenna to which the transversal parasitic radiators and the longitudinal parasitic radiators in this solution are added is shown in FIG. 7(*b*). In FIG. 7(*a*) and FIG. 7(*b*), horizontal coordinates indicate angular values, and vertical coordinates indicate decibel values. It can be found through comparison between FIG. 7(*a*) and FIG. 7(*b*) that, a 3-decibel beamwidth and a 10-decibel beamwidth indicated in FIG. 7(*b*) are respectively less than a 3-decibel beamwidth and a 10-decibel beamwidth indicated in FIG. 7(*a*).

Optionally, the at least two radiating arrays whose operating bands are in the first preset frequency band may be referred to as first-type radiating arrays, and the antenna may further include at least one radiating array 4 (which may be referred to as a second-type radiating array) whose operating band is in a second preset frequency band. When the first preset frequency band is a preset low-frequency band, the second preset frequency band may be a preset high-frequency band. When the first preset frequency band is a preset high-frequency band, the second preset frequency band may be a preset low-frequency band. Each radiating array 4 in the second-type radiating array includes a plurality of radiating elements 41. Each radiating array is electrically disposed on the reflective device 1 along the length direction of the reflective device 1.

Figure 8A:
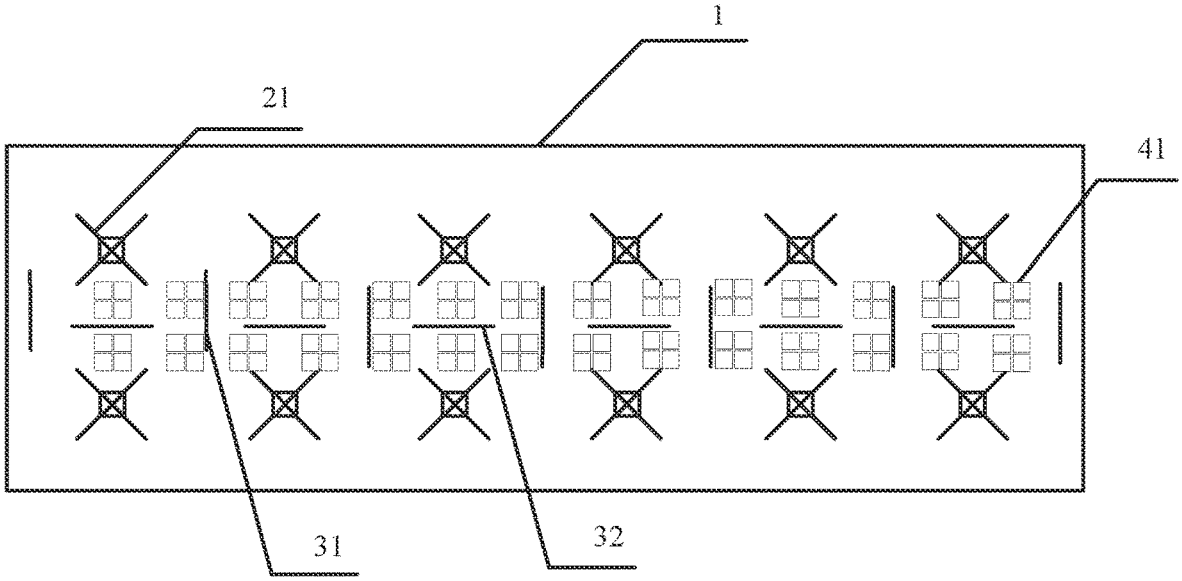
FIG. 8(*a*) is a schematic diagram of an antenna according to an embodiment of the present invention.
Figure 8B:
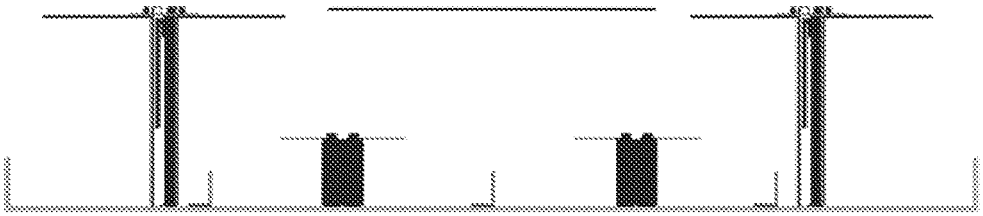

Optionally, geometric centers of radiating elements 41 included in each radiating element pair in second-type radiating arrays 4 may be in a same straight line parallel to the width side of the reflective device 1, and geometric centers of the plurality of radiating elements 41 included in each radiating array 4 may be in a same straight line parallel to the length side of the reflective device 1. For example, when the first preset frequency band is a preset low-frequency band, and the second preset frequency band is a preset high-frequency band, a top view of the antenna may be shown in FIG. 8(*a*), and a side view of the antenna may be shown in FIG. 8(*b*).

Figure 9A:
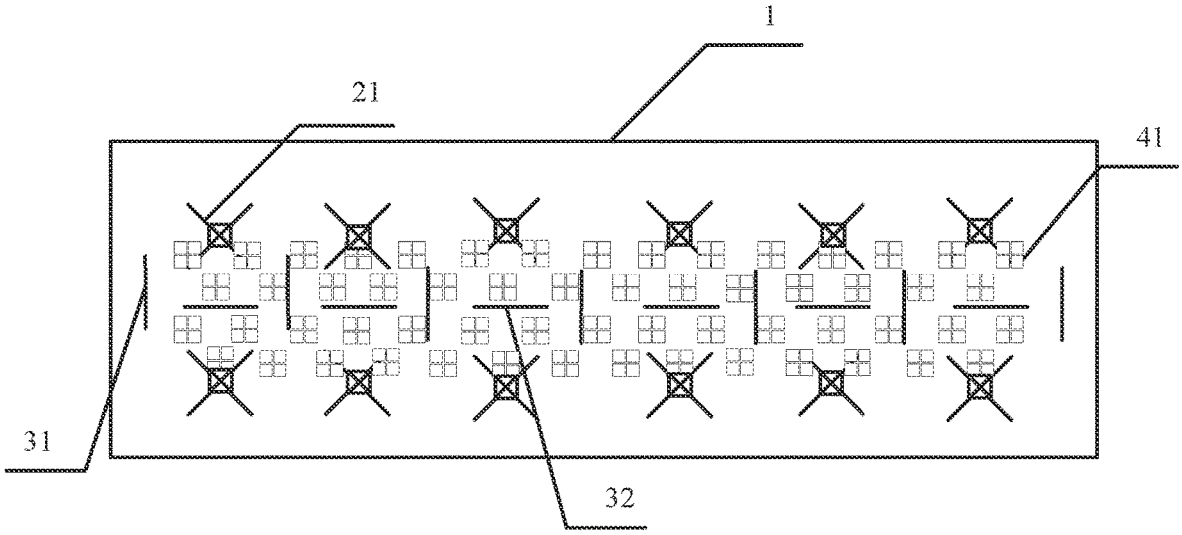
FIG. 9(*a*) is a schematic diagram of an antenna according to an embodiment of the present invention.
Figure 9B:
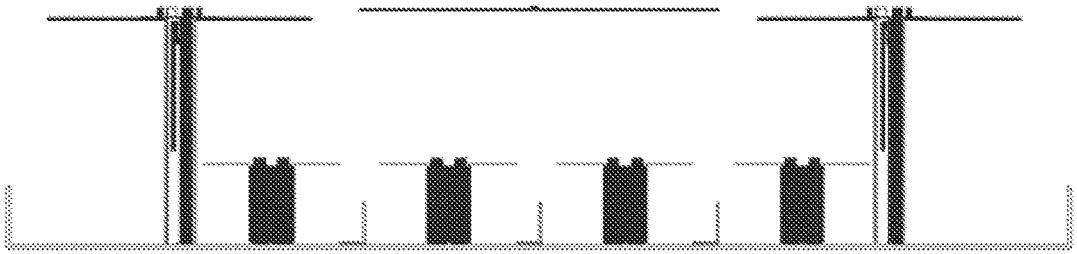

Optionally, the second-type radiating array 4 may be coaxial with the first-type radiating array 2. To be specific, a straight line in which geometric centers of radiating elements in each radiating array 2 in the first-type radiating arrays are located coincides with a straight line in which geometric centers of radiating elements in each radiating array 4 in the second-type radiating array are located. In this way, a size of the antenna can be smaller. Optionally, the geometric centers of the plurality of radiating elements 41 included in each radiating array 4 in the second-type radiating arrays may be in the same straight line parallel to the length side of the reflective device 1, and two adjacent radiating arrays in the second-type radiating arrays 4 are successively staggered along the width direction of the reflective device 1. A distance by which each radiating element pair included in every two adjacent radiating arrays in the second-type radiating arrays 4 is staggered is approximately 0.5 times a distance between adjacent radiating elements in each radiating array 4. The distance by which each radiating element pair is staggered is an offset distance between two radiating elements along the length direction of the reflective device. In other words, when the second-type radiating arrays 4 include four radiating arrays, radiating elements 41 corresponding to the radiating arrays 4 along the width direction of the reflective device 1 are arranged in an S shape. For example, when the first preset frequency band is a preset low-frequency band, and the second preset frequency band is a preset high-frequency band, a top view of the antenna may be shown in FIG. 9(*a*), and a side view of the antenna may be shown in FIG. 9(*b*).

In this embodiment of the present invention, the transversal parasitic radiators are disposed on the two sides of each radiating element pair included in the two adjacent radiating arrays, and/or the longitudinal parasitic radiators are disposed between the two radiating elements included in each radiating element pair. When a radiating array operates, the transversal parasitic radiators and/or the longitudinal parasitic radiators can generate a parasitic radiated electromagnetic wave whose direction is opposite to a direction of a parasitic radiated electromagnetic wave generated by an adjacent radiating array. In other words, the parasitic radiated electromagnetic wave generated by the transversal parasitic radiators and/or the longitudinal parasitic radiators can cancel out the parasitic radiated electromagnetic wave generated by the adjacent radiating array. This reduces the horizontal beamwidth of the multi-array antenna, and further allows the directivity pattern index of the multi-array antenna to meet the requirement of a wireless communications system.

A person of ordinary skill in the art may understand that all or some of the steps of the embodiment may be implemented by hardware or a program instructing related hardware. The program may be stored in a computer-readable storage medium. The storage medium may be a read-only memory, a magnetic disk, an optical disc, or the like.

The foregoing descriptions are merely one embodiment of the present invention, but are not intended to limit this application. Any modification, equivalent replacement, or improvement made without departing from the spirit and principle of this application should fall within the protection scope of the present invention.

The invention claimed is:

1. An antenna, wherein the antenna comprises a reflective device, two radiating arrays, and a transversal parasitic radiator;

wherein each radiating array comprises a plurality of radiating elements extending towards a length direction of the reflective device;

wherein the transversal parasitic radiator extends towards a width direction of the reflective device, and is disposed on one side of a radiating element pair, and wherein the radiating element pair comprises two adjacent radiating elements respectively in the two radiating arrays; and wherein a distance between a midpoint of a vertical projection of the transversal parasitic radiator on a bottom surface of the reflective device and a line connecting the radiating element pair is a preset distance value.

2. The antenna according to claim 1, wherein the vertical projection of the transversal parasitic radiator on the bottom surface of the reflective device is parallel to the line connecting the radiating element pair.

3. The antenna according to claim 1, wherein the midpoint of the vertical projection of the transversal parasitic radiator on the bottom surface of the reflective device is on a line connecting midpoints of radiating element pairs corresponding to the transversal parasitic radiator.

4. The antenna according to claim 1, wherein a height from a vertex of the transversal parasitic radiator to the bottom surface of the reflective device is a value in a preset range comprising 0.25 times a wavelength, and wherein the wavelength is an average value of wavelengths of two adjacent radiating arrays corresponding to the transversal parasitic radiator.

5. The antenna according to claim 1, wherein an effective length of the transversal parasitic radiator is a value in a range of 0.8 times a wavelength to 2.5 times the wavelength, and wherein the wavelength is an average value of wavelengths of two adjacent radiating arrays corresponding to the transversal parasitic radiator.

6. The antenna according to claim 1, wherein the transversal parasitic radiator is disposed between the two radiating arrays.

7. The antenna according to claim 1, wherein the transversal parasitic radiator is disposed in an intermediate region of two radiating element pairs corresponding to the transversal parasitic radiator.

8. The antenna according to claim 1, wherein the antenna further comprises a plurality of longitudinal parasitic radiators, wherein each of the plurality of longitudinal parasitic radiators is disposed along the length direction of the reflective device, and wherein the plurality of longitudinal parasitic radiators are separately disposed between two radiating elements comprised in each radiating element pair in two adjacent radiating arrays corresponding to the transversal parasitic radiator.

9. The antenna according to claim 8, wherein a midpoint of a vertical projection of each longitudinal parasitic radiator on the bottom surface of the reflective device coincides with a midpoint of a line connecting a radiating element pair corresponding to the longitudinal parasitic radiator, and wherein the vertical projection of each longitudinal parasitic radiator on the bottom surface of the reflective device is perpendicular to the line connecting the radiating element pair corresponding to the longitudinal parasitic radiator.

10. The antenna according to claim 8, wherein a height from a vertex of each longitudinal parasitic radiator to the bottom surface of the reflective device is a value in a preset range comprising 0.25 times a wavelength, and wherein the wavelength is an average value of wavelengths of two adjacent radiating arrays corresponding to each longitudinal parasitic radiator.

11. The antenna according to claim 8, wherein an effective length of each longitudinal parasitic radiator is a value in a range of 0.8 times a wavelength to 2.5 times the wavelength, and wherein the wavelength is an average value of wavelengths of two adjacent radiating arrays corresponding to each longitudinal parasitic radiator.

12. The antenna according to claim 1, wherein each radiating element comprised in each of the two radiating arrays is a dual-polarized dipole radiating element or a single-polarized dipole radiating element.

13. The antenna according to claim 1, wherein an operating band of the two radiating arrays is a preset frequency band, and wherein the preset frequency band is a preset low-frequency band or a preset high-frequency band.

14. A wireless communications system, wherein the system comprises an antenna, wherein the antenna comprises a reflective device, two radiating arrays, and a transversal parasitic radiator;

wherein each radiating array comprises a plurality of radiating elements extending towards a length direction of the reflective device;

wherein the transversal parasitic radiator extends towards a width direction of the reflective device, and is disposed on one side of a radiating element pair, and wherein the radiating element pair comprises two adjacent radiating elements respectively in the two radiating arrays; and wherein a distance between a midpoint of a vertical projection of the transversal parasitic radiator on a bottom surface of the reflective device and a line connecting the radiating element pair is a preset distance value.

15. The system according to claim 14, wherein the vertical projection of the transversal parasitic radiator on the bottom surface of the reflective device is parallel to the line connecting the radiating element pair.

16. The system according to claim 14, wherein the midpoint of the vertical projection of the transversal parasitic radiator on the bottom surface of the reflective device is on a line connecting midpoints of radiating element pairs corresponding to the transversal parasitic radiator.

17. The system according to claim 14, wherein a height from a vertex of the transversal parasitic radiator to the bottom surface of the reflective device is a value in a preset range comprising 0.25 times a wavelength, and wherein the wavelength is an average value of wavelengths of two adjacent radiating arrays corresponding to the transversal parasitic radiator.

18. The system according to claim 14, wherein an effective length of the transversal parasitic radiator is a value in a range of 0.8 times a wavelength to 2.5 times the wavelength, and wherein the wavelength is an average value of wavelengths of two adjacent radiating arrays corresponding to the transversal parasitic radiator.

19. The system according to claim 14, wherein the transversal parasitic radiator is disposed between the two radiating arrays.

20. The system according to claim 14, wherein the transversal parasitic radiator is disposed in an intermediate region of two radiating element pairs corresponding to the transversal parasitic radiator.

* * * * *